United States Patent [19]

Steiger

[11] Patent Number: 4,674,448

[45] Date of Patent: Jun. 23, 1987

[54] FUEL INJECTION SYSTEM FOR A MULTI-CYLINDER RECIPROCATING INTERNAL COMBUSTION ENGINE

[75] Inventor: Anton Steiger, Illnau, Switzerland

[73] Assignee: Sulzer Brothers Limited, Winterthur, Switzerland

[21] Appl. No.: 799,903

[22] Filed: Nov. 20, 1985

[30] Foreign Application Priority Data

Jul. 4, 1985 [CH] Switzerland ..... 2885/85

[51] Int. Cl.[4] ..... F02M 39/00

[52] U.S. Cl. ..... 123/23; 123/447; 123/446

[58] Field of Search ..... 123/23, 446, 447; 239/88-95, 533.1-533.12

[56] References Cited

U.S. PATENT DOCUMENTS

| | | | |
|---|---|---|---|
| 1,919,601 | 7/1933 | Simmen | 123/447 |
| 2,625,141 | 1/1953 | Berlyn | 123/23 |
| 2,690,356 | 9/1959 | Berlyn | 123/447 |
| 3,587,547 | 6/1971 | Hussey | 123/447 |
| 4,052,963 | 10/1977 | Steiger | 123/23 |
| 4,280,464 | 7/1981 | Kaioai | 123/447 |
| 4,437,443 | 3/1984 | Hofbauer | 123/447 |
| 4,479,475 | 10/1984 | Babitzka | 123/446 |
| 4,492,191 | 1/1985 | Aoki | 123/446 |
| 4,601,269 | 7/1986 | Kato | 123/446 |
| 4,603,671 | 8/1986 | Yoshinaga | 123/446 |

FOREIGN PATENT DOCUMENTS

| | | | |
|---|---|---|---|
| 0155319 | 12/1979 | Japan | 123/447 |
| 0168050 | 10/1982 | Japan | 123/447 |

*Primary Examiner*—Carl Stuart Miller

*Attorney, Agent, or Firm*—Kenyon & Kenyon

[57] ABSTRACT

The fuel injection system for a multi-cylinder reciprocating internal combustion engine employs an accumulator in the feed line between a feed pump and each of two hydraulic pumps of hydraulic pump pairs. In addition, a high-pressure accumulator is connected on the delivery side in common to all of the hydraulic pumps to eliminate pressure variations. The pumps of each pair of hydraulic pumps are driven in a 45° out-of-phase relation to each other while the adjacent pairs of hydraulic pumps are driven in co-phase relation.

14 Claims, 4 Drawing Figures

FUEL INJECTION SYSTEM FOR A MULTI-CYLINDER RECIPROCATING INTERNAL COMBUSTION ENGINE

This invention relates to a fuel injection system for a multi-cylinder reciprocating internal combustion engine. More particularly, this invention relates to a fuel injection system for supplying a liquid fuel suspension to the cylinders of an internal combustion engine.

As is known, use has been made of various types of fuel injection systems for injecting liquid fuels in the form of a suspension of solid finely divided fuel particles in a liquid. For example, liquid fuels of this kind consist, for example of petroleum coke or coal which has been ground to very fine particles of a size from five (5) to twenty (20) μm and suspended in water and/or oil. Suspensions of this kind are known as slurries.

A conventional system for injecting these liquid fuels has comprised an injection valve and a reciprocating pump which is capable of delivering the liquid fuel to the injection valve. However, as is known, a conventional system of this type has a number of problems, for example, jamming and abrasion of the pump components due to the particles in the fuel.

It has also been known to construct a fuel injection system which employs an injection valve having a gallery for receiving a liquid fuel suspension, a hydraulic pump for delivering liquid fuel to the gallery of the injection valve, a mechanically driven reciprocating pump for driving the hydraulic pump and a feed pump for delivering the fuel to the hydraulic pump. However, in such a system, oressure oscillations occur on the intake side of the hydraulic pump since the feed pump delivers continuously whereas the hydraulic pump can receive fuel only during the intake stroke. In a similar manner, periodic pressure changes occur on the delivery side of the hydraulic pump since there is a particularly strong pressure gradient in the injection valve gallery during the injection phase. As a result, in this phase, there is an increased supply of fuel into the gallery from the hydraulic pump.

In situations where the latter injection system is used for a multi-cylinder reciprocating internal combustion engine, each cylinder has a dedicated hydraulic pump and a common feed pump supplies all the hydraulic pumps. As a result, there is an interaction on both the intake and delivery sides of the hydraulic pumps due to pressure variations. The provision of an accumulator between the feed pump and each hydraulic pump cannot eliminate this interaction on the intake side since undefined states of pressure differences between the accumulator and the feed pump would occur during the overlapping of the charging phases of such accumulators. Further, each accumulator would have to be dimensioned for the total delivery of the associated hydraulic pump.

Since the delivery strokes of the hydraulic pumps cannot be synchronized with the injection phases of the injection valves, the result of the intermittent delivery of the discrete hydraulic pumps in cases in which there is a direct communication with the gallery of the injection valves causes the pressure variations to reach the valves at different times as referred to the charging and discharging of the associated gallery. This leads to inequalities in the quantities injected by the various injection valves.

Accordingly, it is an object of the invention to provide a fuel injection system for a multi-cylinder reciprocating internal combustion engine which obviates pressure oscillations in the feed lines to the hydraulic pump and interaction due to pressure variations both on the intake and delivery sides of the hydraulic pump.

It is another object of the invention to eliminate pressure variations within a fuel injection system for a multi-cylinder reciprocating internal combustion engine.

It is another object of the invention to avoid disturbing pressure gradients within a fuel injection system for a multi-cylinder internal combustion engine.

Briefly, the invention provides a fuel injection system for a reciprocating internal combustion engine having a plurality of cylinders. The injection system includes a plurality of injection valves for receiving a liquid fuel suspension, a plurality of hydraulic pumps for delivering liquid fuel suspension to the valves, a plurality of mechanically driven reciprocating pumps for driving the hydraulic pumps and a feed pump for delivering a continuous supply of liquid fuel suspension to the hydraulic pumps. In accordance with the invention, at least one feed line extends from the feed pump and has a pair of branch lines therein. In addition, an accumulator is connected to and between a respective branch line and a respective pair of hydraulic pumps in order to deliver the liquid fuel suspension to the two hydraulic pumps. Further, a high-pressure accumulator is connected in common to each hydraulic pump in order to receive flow of pressurized liquid fuel suspension therefrom. The high-pressure accumulator is also connected in common to the injection valves in order to deliver the pressurized liquid fuel suspension to each respective injection valve individually. In this regard, delivery lines of equal length connect the high-pressure accumulator to the respective injection valves.

The fuel injection system also includes a means for driving each pump of a respective pair of hydraulic pumps in a 45° out-of-phase relation to each other while driving each pair of adjacent pairs of hydraulic pumps in co-phase relation.

The accumulators which are disposed between the feed pump and pairs of hydraulic pumps are constructed with a chamber for receiving liquid fuel from the feed line and a movable piston in the chamber to accommodate pressure variations of the liquid fuel in the chamber.

Associating a junction with each pair of hydraulic pumps and providing an accumulator at the junction obviates interaction on the delivery side of the accumulators due to pressure variations. This is enhanced since the corresponding hydraulic pumps of the pairs of pumps operate co-phasally and the mechanical pumps are driven synchronously. A further advantage is that, because of the 45° phase shift of the hydraulic pumps, each of the accumulators between the feed pump and hydraulic pumps requires dimensioning only for the total delivery of one of the two connected hydraulic pumps.

The interposition of a common high-pressure accumulator between the hydraulic pumps and the injection valves reduces pressure variations on the delivery side of each hydraulic pump to such an extent that interaction is negligible. Consequently, the same pressure differences are operative for all the injection valves in the injection phase. Hence, irregularities in the injection characteristics of the various injection valves are obviated.

A further advantage of the injection system is that the number of hydraulic pumps can be less than the number of cylinders of injection valves of the engine. For example, the fuel injection system may include four reciprocating pumps disposed in two pairs and four hydraulic pumps in combination with seven injection valves.

By having the length of all of the delivery lines from the high-pressure accumulator to the injection valves the same, the remaining pressure variations due to removal from the common accumulator due to the injection and discharging events do not cause irregularities in the quantity injected by the injection valve.

These and other objects and advantages of the invention will become more apparent from the following detailed description taken in conjunction with the accompanying drawings wherein.

Figure 1:
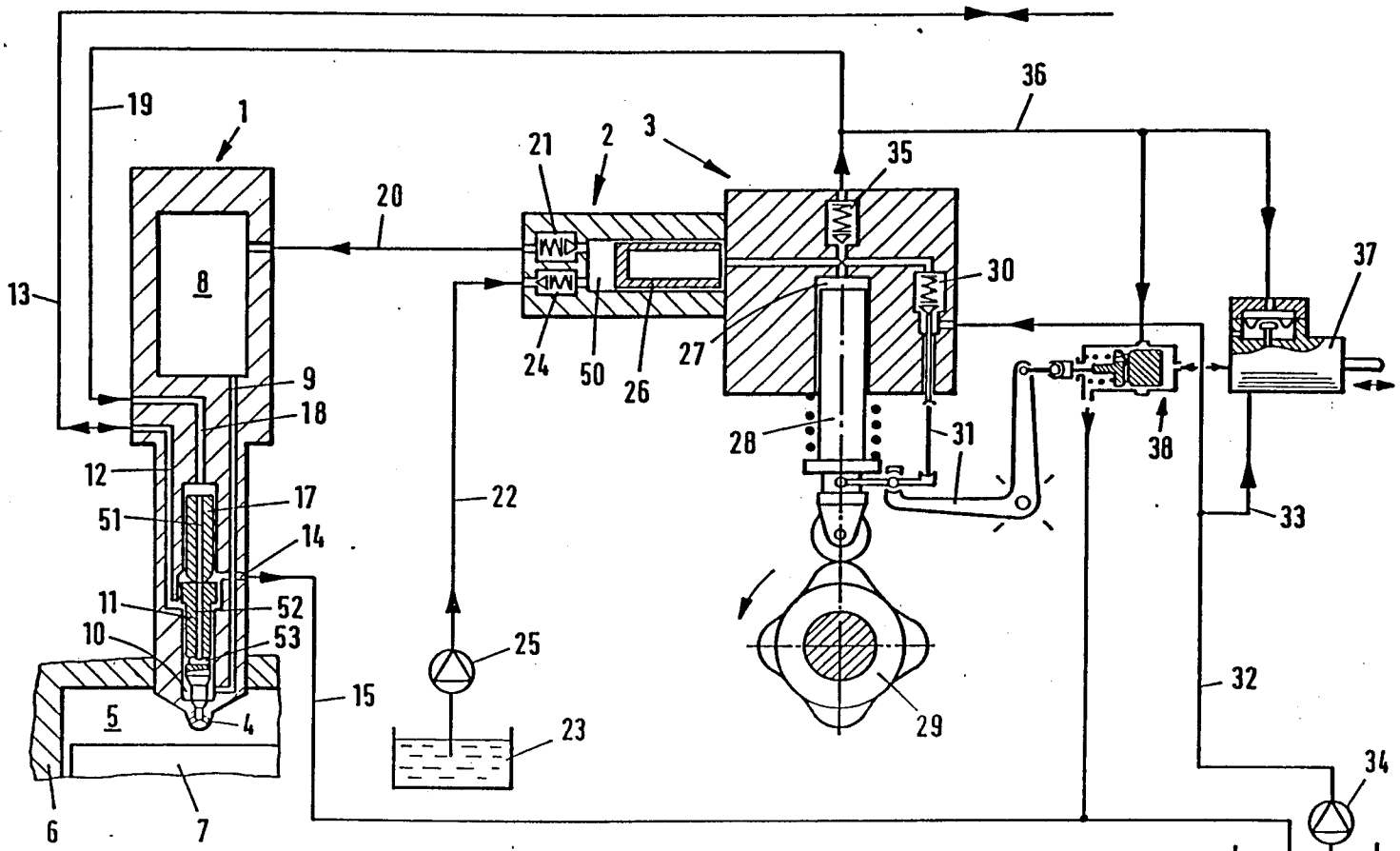
FIG. 1 illustrates a diagrammatic view of an injection system constructed in accordance with the prior art.

Referring to FIG. 1, the known fuel injection system which is further described in Swiss patent application No. 504/85 filed Feb. 5, 1985 includes an injection valve 1, a hydraulic reciprocating pump 2 and a mechanically driven reciprocating pump 3.

The injection valve 1 has a bottom end, as viewed, which is formed with a number of spray apertures 4 and extends into a combustion chamber 5 of a reciprocating internal combustion engine, i.e. a diesel engine. As indicated, a cylinder 6 and a reciprocable work piston 7 bound the combustion chamber 5.

The valve 1 has a body which defines a gallery 8 for receiving a liquid fuel under an injection pressure of, for example one thousand (1000) bar, when the engine is in operation. The liquid fuel is in the form of a suspension of solid finely divided fuel particles, such as coal in a liquid, such as water or diesel oil. The gallery 8 communicates by way of a bore 9 in the valve body with a chamber 10 in which a valve needle 11 is disposed. The valve needle 11 cooperates with a sealing seat in the valve body for controlling a flow of the liquid fuel from a gallery 8 to the combustion chamber 5 via the spray apertures 4. As shown, the valve needle 11 is guided in a bore in the valve body and extends upwardly to a thickened piston-fashioned portion at the upper end. This thickened end is guided in a correspondingly large bore.

The valve body also includes a duct 12 which communicates with the bore below the thickened part of the valve needle 11 with a line 13 which leads to a timing pump (not shown).

A duct 14 is also formed in the valve body above the valve needle 11 and extends to a discharge line 15 which leads to a sump or the like 16 which contains a hydraulic pressure medium.

A pressure medium actuated biasing piston 17 is also disposed in the injection valve 1 for maintaining the valve needle 11 closed. As indicated, the piston 17 is guided coaxially of the valve needle 11 in a bore of the valve body. The piston 17 is of smaller diameter than the thickened end of the valve needle 11 but is of greater diameter than the part of the valve needle below the thickened end. In addition, the injection valve body includes a duct 18 which communicates with the upper end of the piston 17 and a line 19 which conveys a pressure medium from the mechanically driven pump 3.

The piston 17 is formed with a continuous axial bore 51 which communicates directly with an axial bore 52 in the upper half of the valve needle 11. This axial bore 52 terminates in a cross-bore 53 in the valve needle which, in turn, terminates in an annular groove in the periphery of the valve needle 11. This annular groove serves to define an annular chamber about the valve needle 11 for purposes as described below.

As shown in FIG. 1, the injection valve gallery 8 communicates by way of a line 20 and a pressure valve 21 with a delivery chamber 50 of the hydraulic pump 2. In addition, the pump 2 receives a supply of liquid fuel from a supply tank 23 via an intake line 22 in which a feed pump 25 is disposed. As shown, the line 22 connects to an intake valve 24 which leads to the delivery chamber 50 of the pump 2. Of note, each of the valves 21, 24 can be an inherently stable check valve, for example as described in Swiss patent application 505/85-2 filed Feb. 2, 1985.

As illustrated, the pump 2 includes a reciprocable piston 26 which communicates with a delivery chamber 27 of the mechanically driven pump 3 on the side remote from the valves 21, 24.

The mechanically driven pump 3 includes a piston 28 which is reciprocated via a cam shaft 29 which is drivingly connected to the engine crank shaft in a known manner (not shown) to reciprocate at the cadence of the work piston 7. The cam concerned can be a multiple cam since sychronism with the piston position is not required although such does improve pump capacity. The mechanically driven pump 3 has an intake valve 30 which acts in a known manner by way of a linkage 31 to control the start of delivery of the pump 3. The intake valve 30 communicates by way of an intake line 32 with the sump or pan or like 16 to receive a flow of hydraulic medium. As indicated, a feed pump 34 is provided in the line 32.

A check valve 35 is also provided in the pump 3 and connects with the line 19 which extends to the biasing piston 17 of the injection valve 1.

A measuring line 36 is connected to the line 19 while a measuring line 33 is connected to the intake line 32 downstream of the feed pump 34. The two measuring lines 33, 36 extend to a control element 37 which forms a difference between the pressures in the two lines 33, 36 with a hydraulic regulating element 38 which acts on the linkage 31 being actuated in dependence upon the pressure difference measurement. This control adjusts the fuel pressure which is required in the gallery 8 and which varies in dependence upon engine loading.

When the engine is running, hydraulic pressure medium at a pressure of twenty (20) bar taken in by the pump 3 from the line 32 has its pressure increased, as the piston 28 rises, to the higher value of one thousand (1000) bar in the delivery chamber 27. This pressurized hydraulic pressure medium then acts on the piston 26 of the hydraulic pump 2. Consequently, the piston 26 displaces to the left, as viewed, to discharge liquid fuel from the delivery chamber 50 through the check valve 21 and line 20 to the injection valve gallery 8.

The pressure of the fuel in the delivery chamber 50 is below the pressure of the hydraulic pressure medium actuating the piston 26. Consequently, very fine particles of fuel cannot penetrate between the sliding surfaces of the piston 26 and the surrounding cylinder wall and remain there. Hence, there is no risk of the piston 26 jamming.

At the same time, the high pressure medium passes from the delivery chamber 27 through the check valve 35, line 19 and duct 18 to the piston 17 so that the valve needle 11 is kept closed, for example in intervals between injection phases. Also, pressure medium passes through the central bore 51 in the piston 17 and through the bore 52 and cross bore 53 in the valve needle 11 into the annular groove about the valve needle 11. This pressure medium exits closely above the chamber 10 so that, in this region, a pressure difference exists which decreases towards the chamber 10 and thus inhibits any entry of solid particles into the guide bore for the valve needle 11.

The timing pump (not shown) which is connected to the line 13 determines the start and duration of injection and produces a pressure during the injection phase which acts on the underside of the piston-like thickened end of the valve needle 11 and overcomes the closing force of the pressure medium acting on the piston 17. Hence, the valve needle 11 disengages from the valve seat and fuel is injected from the chamber 10, bore 9 and gallery 8 through the spray apertures 4 into the combustion chamber 5.

When the piston 28 of the pump 3 descends, the pressure of the pressure medium in the delivery chamber 27 and on the piston 26 decreases. Hence, the piston 26 returns to the right, as viewed in FIG. 1, and in so doing intakes fuel from the supply tank 23 through the intake line 22 and intake valve 24 into the delivery chamber 50.

At the same time, the pressure on the piston 17 via the line 13 is relieved so that the pressure on the piston 17 causes the valve needle 11 to again close.

Figure 2:
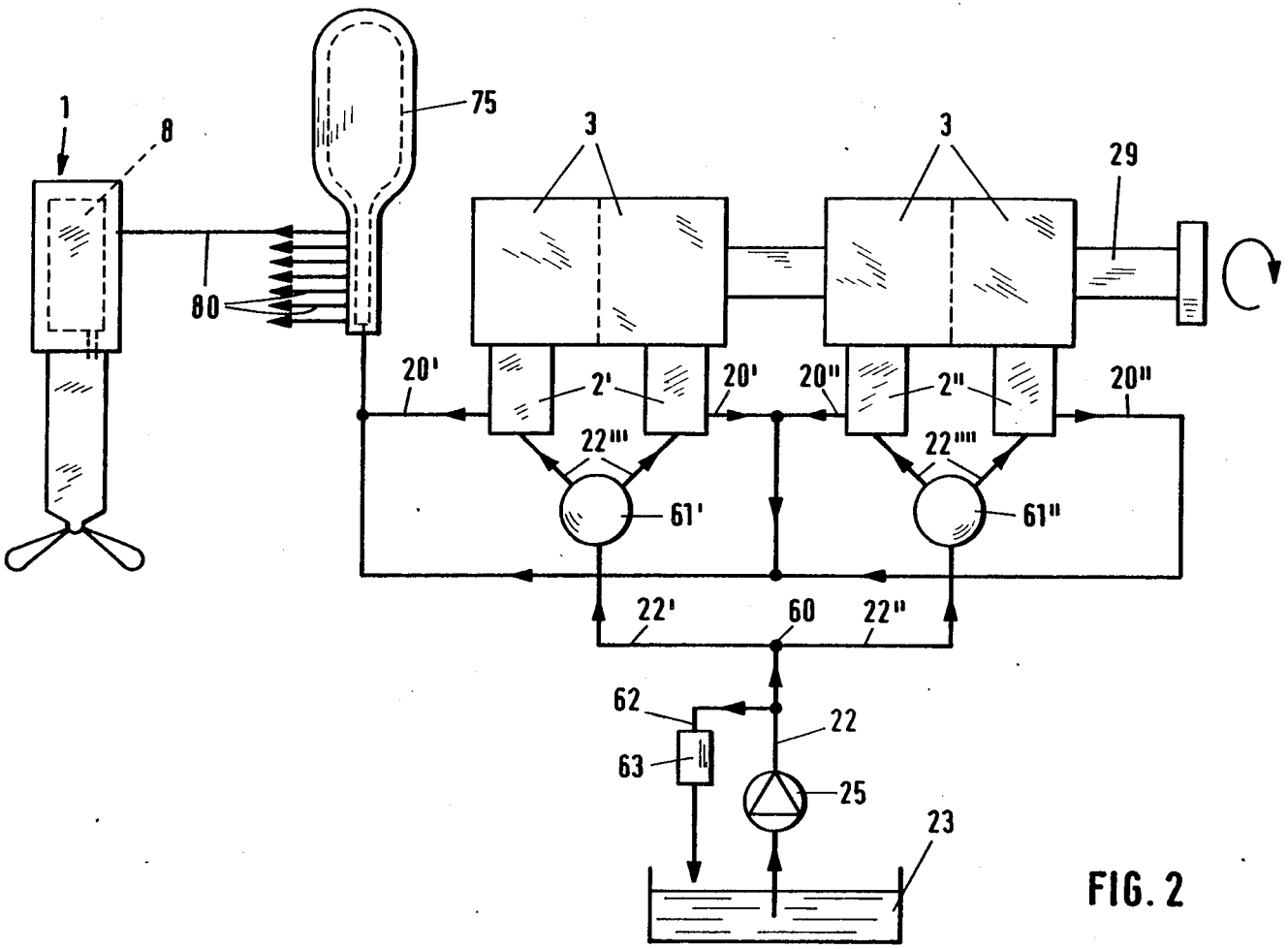
FIG. 2 illustrates a diagrammatic view of an injection system constructed in accordance with the invention.

Referring to FIG. 2, wherein like reference characters indicate like parts as above, the fuel injection system is constructed for use with a reciprocating internal combustion engine having seven cylinders (not shown) each of which has an injection valve 1 constructed therefor. In addition, the injection system employs four hydraulic piston pumps 2', 2'', four mechanically driven piston pumps 3 and a common feed pump 25. As indicated, the mechanically driven pumps 3 have pistons which are received in a common pump casing for driving the hydraulic pumps 2', 2''.

A feed line 22 extends from the feed pump 25 in order to convey a flow of liquid fuel to a pair of branch lines 22', 22'' which branch from a common point 60. Each branch line 22', 22'' extends in parallel to the other to respective junctions at which an accumulator 61', 61'' is situated. A pair of branch lines 22''', 22'''' extend from the respective accumulators 61', 61'' to a pair of hydraulic pumps 2',2'' as indicated.

Figure 3:
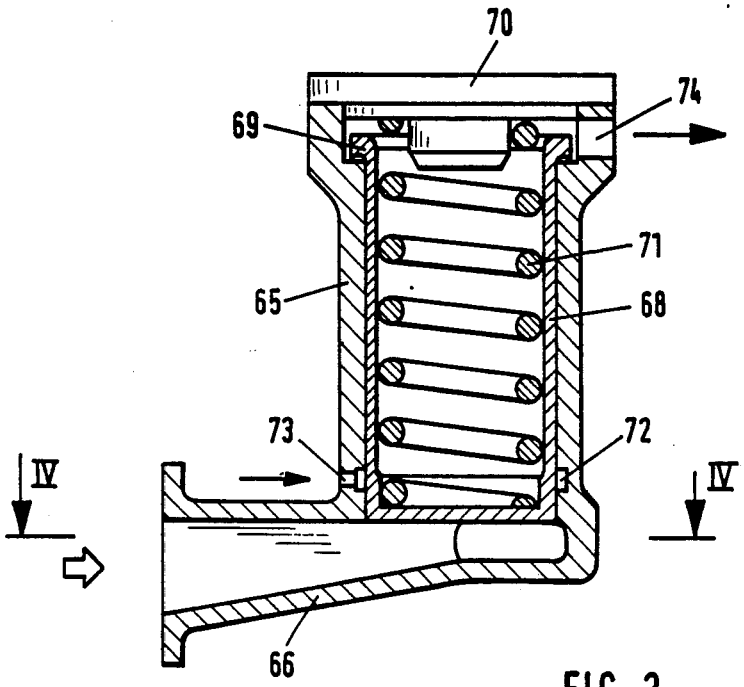
FIG. 3 illustrates an axial sectional view through an accumulator connected between a feed pump and a pair of hydraulic pumps in accordance with the invention.
Figure 4:
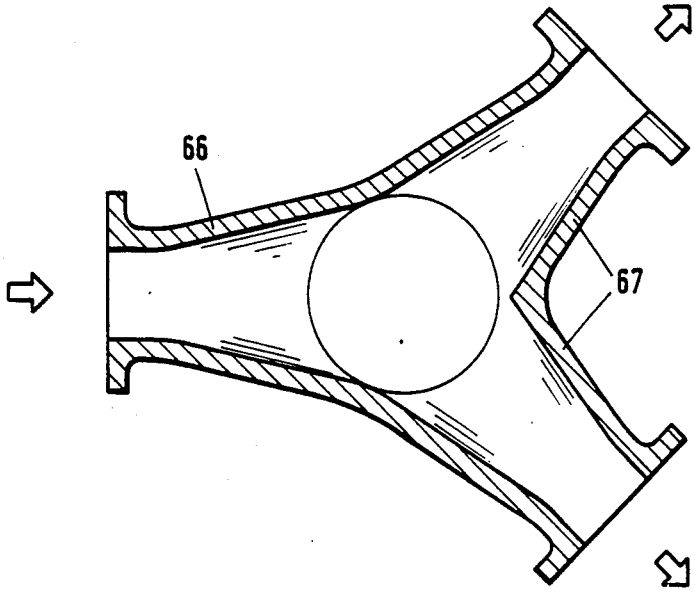
FIG. 4 illustrates a view taken on line IV—IV of FIG. 3.

Referring to FIGS. 3 and 4, each accumulator includes a casing 65 having an inlet connection 66 connected to the feed branch line from the feed line 22 (not shown) and a pair of discharge connections 67 for connecting to the branch lines to the hydraulic pumps (not shown). The casing 65 is of cylindrical shape so as to define a chamber above the connections 66, 67 and receives a movable piston 68 which is carried by way of a flange 69 at the top end on a shoulder of the casing 65. In addition, a helical spring 71 is provided within the piston 68 and against a cover 70 of the casing 65 in order to bias the piston 68 into the normal position illustrated, i.e. with the flange 69 against the shoulder of the casing 65. Should the pressure increase within the inlet connection 66, the piston 68 is able to rise in order to accommodate the increased pressure of the liquid fuel in the chamber.

As indicated in FIG. 3, an annular groove 72 is formed near the bottom end of the cylinderical casing 65 and is associated with a feed bore 73 to which a line (not shown) for a barrier medium is connected. The barrier medium, for example a liquid such as oil, is supplied through the line at a higher pressure than the maximum pressure of the fuel in the inlet connection 66 in order to produce a pressure difference which decreases towards the fuel and which prevents solid particles thereof from penetrating between the rubbing surfaces of the piston 68 and the casing 65. A bore 74 is also disposed in the casing 65 near the piston flange 69 to permit discharge of the barrier medium.

Referring to FIG. 2, an overflow line 62 having an overflow valve 63 is connected to the feed line 22 between the feed pump 25 and the junction 60. The overflow valve 63 allows fuel delivered by the feed pump 25 to return to the supply tank 23 when the fuel pressure in the line 22 exceeds a particular value. This usually occurs when the pistons of the hydraulic pumps 2', 2'' are making a delivery stroke.

The four hydraulic pumps 2', 2'' are connected on the delivery side by way of delivery lines 20', 20'' to a common high-pressure accumulator 75 of sufficient volume to receive the fuel pressurized to the delivery pressure of the hydraulic pumps. The accumulator 75 is in turn connected via delivery lines 80 each of which is connected to a respective injection valve 1 in order to deliver liquid fuel to the gallery 8 thereof. As indicated, seven delivery lines 80 extend from the high-pressure accumulator 75 to the respective valve.

A means is also provided for driving each hydraulic pump 2', 2'' of each pair of hydraulic pumps in a 45° out-of-phase relation to each other while driving each pair of adjacent pairs of hydraulic pumps 2',2'' in co-phase relation. This means includes a cam shaft 29 which is common to the reciprocating pumps 3 and four cams (not shown), each of which has four camming elements for driving a respective reciprocating pump 2',2''. For example, each cam is constructed in the manner of the cam 29 illustrated in FIG. 1. In this respect, the camming elements on one cam are offset from the next cam by 45° so that the hydraulic pumps of any given pair of hydraulic pumps are driven 45° out-of-phase with respect to each other.

The two pump groups are also in phase with one another, that is, the four-element cams associated with the two hydraulic pumps 2'' on the right of FIG. 2 run in synchronism with one another while the same considerations apply to the two hydraulic pumps 2' on the left of FIG. 2.

Because of the phase relationship, the piston 68 of the accumlators 61', 61'' move completely co-phasally so that the pressure variations on the intake side of the accumulators are also co-phasal and no disturbing pressure gradients can arise between the two accumulators 61', 61''. Interaction is therefore excluded.

The invention thus provides a fuel injection system which can be used with a multi-cylinder reciprocating internal combustion engine without having pressure variations occur in the fuel injection.

The invention further provides a relatively simple fuel injection system which employs a minimum number of parts to achieve a relatively efficient system which avoids pressure variations in the fuel delivery.

What is claimed is:

1. A fuel injection system for a reciprocating internal combustion engine having a plurality of cylinders, said system comprising a plurality of injection valves, each valve having a gallery for receiving a liquid fuel suspension of solid finely divided fuel particles in a liquid under an injection pressure;

a plurality of hydraulic pumps for delivering liquid fuel suspension to said valves, each hydraulic pump having a delivery stroke 45° out of phase with another hydraulic pump of a respective pair of hydraulic pumps;

a plurality of mechanically driven reciprocating pumps, each said reciprocating pump communicating with a respective hydraulic pump to drive said hydraulic pump with adjacent pairs of hydraulic pumps driven in co-phase relation;

a feed pump for delivering a continuous supply of liquid fuel suspension;

at least one feed line extending from said feed pump and having a pair of branch lines therein;

at least two accumulators, each accumulator being connected to and between a respective branch line and a respective pair of said hydraulic pumps to deliver the liquid fuel suspension to said hydraulic pumps; and a high-pressure accumulator connected in common to each said hydraulic pump to receive respective flows of pressurized liquid fuel suspension therefrom, said high-pressure accumulator being connected in common to said injection valves to deliver the pressurized liquid fuel suspension to each respective injection valve individually.

2. A fuel injection system as set forth in claim 1 wherein each accumulator connected to a respective branch line includes a movable piston.

3. A fuel injection system as set forth in claim 1 which further includes a plurality of delivery lines extending from said high-pressure accumulator, each said delivery line being connected to a gallery of a respective injection valve to deliver liquid fuel suspension thereto.

4. A fuel injection system as set forth in claim 3 wherein said delivery lines are of equal length to each other.

5. A fuel injection system as set forth in claim 1 which further comprises a plurality of cams, each said cam having four camming elements thereon for driving a respective reciprocating pump.

6. A fuel injection system as set forth claim 1 which further comprises means for supplying a liquid barrier medium to each piston of a respective accumulator connected to a respective branch line at a pressure higher than the pressure of fuel suspension in said respective accumulator.

7. A fuel injection svstem as set forth in claim 1 including four of said reciprocating pumps disposed in two pairs and four hydraulic pumps.

8. A fuel injection system as set forth in claim 7 which includes seven injection valves.

9. A fuel injection system for an internal combustion engine comprising a feed pump for delivering a supply of liquid fuel;

at least one feed line extending from said feed pump and having a pair of branch lines therein;

at least two accumulators, each accumulator being connected to a respective branch line to receive a flow of liquid fuel therefrom;

at least two pairs of hydraulic pumps, each pair of hydraulic pumps being connected to a respective accumulator to receive liquid fuel therefrom;

a plurality of mechanically driven reciprocating pumps, each reciprocating pump being connected to a respective hydraulic pump to drive said hydraulic pump;

a high-pressure accumulator connected in common to said hydraulic pumps to receive pressurized liquid fuel therefrom; and a plurality of injection valves, each said injection valve being connected in parallel to said high pressure accumulator to receive pressurized liquid fuel therefrom.

10. A fuel injection system as set forth in claim 9 wherein each accumulator connected to a respective branch line includes a chamber for receiving liquid fuel from said feed line and a movable piston in said chamber to accommodate pressure variations of the liquid fuel in said chamber.

11. A fuel injection system as set forth in claim 9 which further comprises means for driving each pump of each said pair of hydraulic pumps in a 45° out-of-phase relation to each other while driving each pair of adjacent pairs of hydraulic pumps in co-phase relation.

12. A fuel injection system as set forth in claim 11 wherein said means includes a cam shaft common to said reciprocating pumps, and a plurality of cams on cam shaft, each cam having four camming elements for driving a respective reciprocating pump.

13. A fuel injection system as set forth in claim 9 which further includes a plurality of delivery lines extending from said high-pressure accumulator, each said delivery line being connected to a respective injection valve to deliver liquid fuel thereto.

14. A fuel injection system as set forth in claim 13 wherein said delivery lines are of equal length to each other.

* * * * *